United States Patent [19]

Lewis et al.

[11] Patent Number: 4,641,748

[45] Date of Patent: Feb. 10, 1987

[54] PACKAGE FOR CIGARETTES AND THE LIKE

[75] Inventors: Robert T. Lewis; Thomas T. Tudor, both of Louisville, Ky.

[73] Assignee: Brown & Williamson Tobacco Corporation, Louisville, Ky.

[21] Appl. No.: 789,527

[22] Filed: Oct. 21, 1985

[51] Int. Cl.[4] ..... B65D 5/32; B65D 85/10

[52] U.S. Cl. ..... 206/263; 206/251; 206/261; 206/267; 206/273; 229/44 CB

[58] Field of Search ..... 206/251, 259, 261, 263, 206/265, 266, 267, 273, 270, 275; 229/44 CB, 9; 220/4 B, 4 E

[56] References Cited

U.S. PATENT DOCUMENTS

| | | | |
|---|---|---|---|
| 1,154,589 | 9/1915 | Wolf | 206/251 |
| 1,735,323 | 11/1929 | L'Enfant | 206/45.15 |
| 1,735,324 | 11/1929 | L'Enfant | 206/251 |
| 3,058,646 | 10/1962 | Gvyer | 229/44 CB |
| 3,608,812 | 9/1971 | Hamilton | 229/44 CB |
| 3,749,234 | 7/1973 | Gero | 206/266 |
| 3,881,599 | 5/1975 | Flaherty | 229/44 CB |
| 4,172,520 | 10/1979 | Gero | 229/44 CB |
| 4,445,612 | 5/1984 | Shepherd | 206/232 |
| 4,534,463 | 8/1985 | Bouchard | 206/267 |

FOREIGN PATENT DOCUMENTS

| | | | |
|---|---|---|---|
| 318774 | 9/1929 | United Kingdom | 229/9 |

*Primary Examiner*—William Price
*Assistant Examiner*—Brenda J. Ehrhardt
*Attorney, Agent, or Firm*—Charles G. Lamb

[57] ABSTRACT

A package for cigarettes and the like includes an article container box having an open top through which the cigarettes are removed from the container box. The package further includes two side box sections having facing open sides. The two side box sections symmetrically enclose the container box when in a closed position. The two side box sections are hinged together at the juncture of their floors for pivotal movement in a fan-like movement between a closed position covering the open top of the container box and an open position uncovering the open top of the container box. The container box and each of the side box sections include interacting stop flanges which limits the pivotal movement of side box sections, when in the open position, to an open-most position whereat each of the side box section still receives a portion of the container box.

11 Claims, 7 Drawing Figures

PACKAGE FOR CIGARETTES AND THE LIKE

BACKGROUND OF THE INVENTION

The present invention relates to packages for cigarettes, and the like, and more particularly to a package which has a pair of outer side box sections hinged together for movement in a fan-like manner over an article container box for covering and uncovering the article access opening in the container box.

The prior art teaches various packages for cigarettes and the like which open in a fan-like manner.

U.S. Pat. No. 1,735,324 issued on Nov. 12, 1929 to Charles L'Enfant discloses a package for cigarettes which includes an article holder box for receiving a package of cigarettes. The article holder box has an open top so that the cigarettes can be removed from the holder box. The top edges of the side walls of the article holder box are cut away to afford convenient access to the cigarettes in the holder box. The holder box is enclosed by two case sections. The article holder box and two case sections are fabricated of sheet metal. A metal plate is spaced above the lower end wall of each case section and is fastened to the side walls of the case sections. The case sections are located over the article holder box such that when closed over the article holder box, the peripheral edges of the side walls, upper end walls and lower end walls abut at the open sides of the case sections. The ends of the metal plate at the open sides of the case sections are connected by a hinge, and the edges of the case sections between the hinge and lower end wall of the case sections are cut away in opposite directions to provide a clearance so that the case sections can be pivoted away from each other about the hinge. A U-shaped spring clip is affixed to the bottom wall of the article holder box such that the arms of the clip project downwardly through the clearance space at the bottom of the case sections to engage the spaced edges of the lower end wall of the case sections to bias the case sections to the closed position enclosing the article holder box. In addition, a flexible strap extends across the bottom wall of the article holder box and has opposite extending ends which fit into the corners formed by the metal plate in the case sections and end walls of the case section to limit the extent of relative opening of the case sections.

U.S. Pat. No. 3,058,646 issued on Oct. 16, 1962 to R. Guyer discloses a reclosable package for cigarettes formed of two complementary sections which are hingedly connected together. The package includes a partial liner which is secured to one of the sections and which telescopes into the other section. This liner is arranged to hold cigarettes contained in one section when the other section is hinged away so that the cigarettes can be removed. The package further includes a pair of tabs forholding the sections either in the open or closed position. The pair of tabs are cut from a portion of the liner panel and the ends of each of these tabs is adhered to the pivotally supported section. The anchoring of these tabs to the pivotal section acts to normally hold the pivotal section in the closed position. As the pivotal closure section is hinged to the open position, the tabs unfold in a manner to cause the side walls of the pivotal closure section to be flexed outwardly placing the tabs under compression until the pivotal section is in the fully open position. The action of the tabs create a resistance to folding the pivotal closure section either out of the closed position or out of the fully open position.

Other U.S. Patents which disclose various types of cigarette packages having movable closure members include U.S. Pat. Nos. 356,244; 578,669; 1,230,498; 1,735,325; 1,877,468; 2,950,060; 3,373,920; 3,583,625; and 4,172,520.

Some foreign patents which disclose various types of cigarette packages having movable closure numbers include: Australian Pat. No. 23,397 issued Nov. 4, 1929; Great Britain Pat. No. 1,263,203 published Feb. 9, 1972; Great Britain Pat. No. 979,355 published Jan. 1, 1965; and French Pat. No. 1,208,736 published Feb. 25, 1960.

SUMMARY OF THE INVENTION

An object of the present invention is to provide a package for cigarettes, and the like, which is disposable after the cigarettes have been removed.

Another object of the present invention is to provide a package for cigarettes which includes two side box sections pivotally connected to each other for pivotal movement toward each other enclosing a control cigarette container box, and away from each other to an open position exposing the cigarettes contained in the central container box.

A further objective of the present invention is to provide a cigarette package of the class described wherein the pivotally connected side boxes are adapted to be selectively simultaneously pivoted between the open and closed positions, or individually pivoted between the open and closed positions.

Yet another object of the present invention is to provide such a cigarette package wherein the pivotal side boxes are free of any forces which tend to cause movement of the side boxes between the open and closed positions.

Still yet another object of the present invention is to provide such a cigarette package including stop tabs which limit the movement of the side box sections to the fully open position.

More particularly, the present invention provides a package for cigarettes and the like which comprises a first side box section having a front wall, a rear wall, a top wall, a floor, a side wall, and an open side opposite the side wall defined by the side edges of the front wall, rear wall, top wall, and floor; a second side box section having a front wall, a rear wall, or top wall, a floor, a side wall, and an open side opposite the side wall defined by the side edges of the front wall, rear wall, top wall, and floor; the first and second side box sections being located in side-by-side disposition with the open sides thereof in mutually facing relationship; a strip of flexible, non-resilient material fastened to the floor of each side box such that the side edges of the floors, of the side box sections are in juxtaposition, and functioning as a hinge so that the side box sections can be manually and freely pivoted selectively either simultaneously or individually about the hinge between a closed position wherein the first and second side box sections are located in side-by-side disposition with the open sides in registered facing relationship with the side edges of the front wall, rear wall, top wall and floor of the first side box sections in aligned abutment with the side edges of the front wall, rear wall, top wall and floor of the second side box section, respectively, and an open position wherein the open sides of the side box sections are spaced apart from each other; an article container box having two spaced apart, parallel end walls, a front wall, a rear wall spaced apart from and parallel to the front wall, a floor, and an open top defined by the top edges of the end walls, front wall and rear wall, the article container box being received within the first and second side box sections wherein one container box end wall is received through the open side of the first side box section, the other container end wall is received through the open side of the second side box section, the open container box top is covered by the top walls of the first and second side box sections when the side box sections are in the closed position; and the open container box top is at least partially uncovered by the top walls of the first and second side box sections. When the side box sections are pivoted to the open position, the article container box being appropriately sized such that a frictional force is created between the front wall of the container box and front walls of the side box sections, and between the rear wall of the container box and rear walls of the side box sections sufficient to hold the side box sections in any position between closed and fully open absent the application of a manual force to the side box sections; and stop tab means associated with the container box and each of the side box sections to prevent pivotal movement of the side box sections to a position whereat the side edge of the top wall of each of the side box sections is outside of the open top of the container box.

BRIEF DESCRIPTION OF THE DRAWINGS

A better understanding of the present invention will be had upon reference to the following description in conjunction with the accompanying drawings in which like numerals refer to like parts thoughout the several views and wherein.

DETAILED DESCRIPTION OF THE PREFERRED EMBODIMENT

Figure 1:
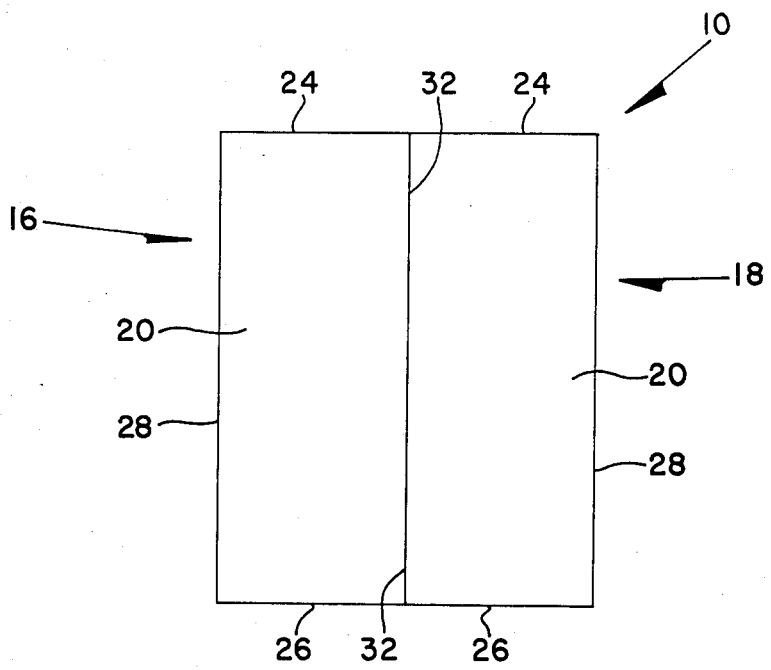
FIG. 1 is a front view of the cigarette package of the present invention in a closed position.
Figure 2:
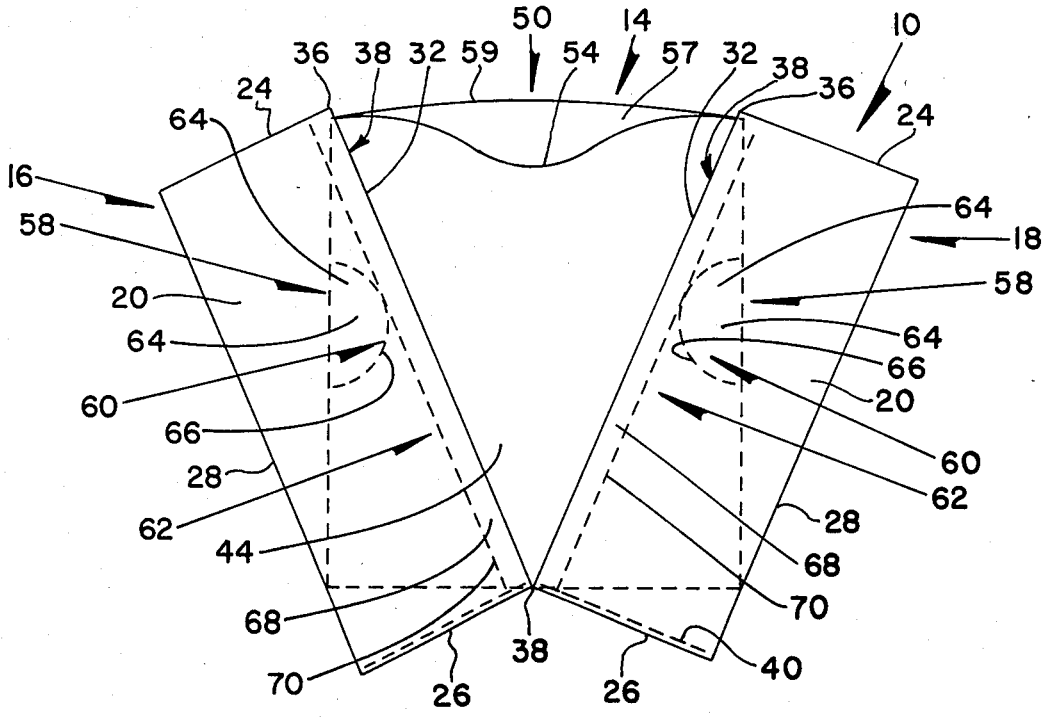
FIG. 2 is a front view of the cigarette package of the present invention in an open position with portions broken away to show a stop.

With reference to FIGS. 1 and 2, there is shown a package, generally denoted as the numeral 10, for cigarettes and the elongated objects like. The package 10 includes an article container box 14 and two identical first and second side box sections 16 and 18, respectively, adapted to enclose the article container box 14.

The first and second side box sections 16 and 18 substantially identical and each includes a front wall 20, a rear wall 22 spaced from and parallel to the front wall 20, a top wall 24, a floor 26 spaced from and parallel to the top wall 24, a side wall 28, and an open side 30 opposite the side wall 28 defined by the front wall edge 32, rear wall edge 34, top wall edge 36 and floor edge 38. The first and second side box sections 16 and 18 are located in side-by-side disposition with the open sides 30 thereof in mutually facing relationship The first and second side box sections 16 and 18 are pivotally connected together such that the side edges 38 of their floors 26 are in juxtaposition by a strip of pliant flexible, non-resilient material 40 fastened over the floors 26 of the first and second side box sections 16 and 18. The strip 40 functions as a hinge so that the side box sections 16 and 18 can be manually and freely pivoted, either simultaneously or individually as the user may select, about the hinge between a closed position, show in FIG. 1, and a fully open position, shown in FIG. 2. When in the closed position, the side box sections 16 and 18 are located in side-by-side disposition with the open sides 30 in registered facing relationship and with the front wall side edge 32, rear wall side edge 34, top wall side edge 36 and floor edge 38 of the first side box section 16 in aligned abutment with the front wall side edge 32, rear wall side edge 34, top wall side edge 36 and floor edge 38 of the second side box section 18, respectively. When in the fully open position, the open sides 30 and the top walls 24 of the first and second side box sections are spaced apart.

The article container box 14 has two spaced apart, parallel end walls 42, a front wall 44, a rear wall 46 spaced apart from and parallel to the front wall 44, a floor 48, and an open top 50. The open top 50 is defined by the top edges 52 of the end walls 42, the top edge 54 of the front wall 44, and the top edge 56 of the rear wall 46. The article container box 14 is symmetrically received within the first and second side box sections 16 and 18. One end wall 42 of the container box 14 is received through the open side 30 of the first side box section 16 and the other end wall 42 of the container box 14 is received through the open side of the second side box section 18. When the first and second side box sections 16 and 18 are in the closed position, the open article container top 50 is symmetrically covered by the top walls 24 of the first and second side box sections 16 and 18. When in the fully open position, the top walls 24 of the side box sections 16 and 18 slightly overlap the top edges 52 of the end walls 42 of the article container box 14, but the top walls 24 are spaced apart to expose or uncover a vast majority of the open top 50 of the container box 14.

Figure 3:
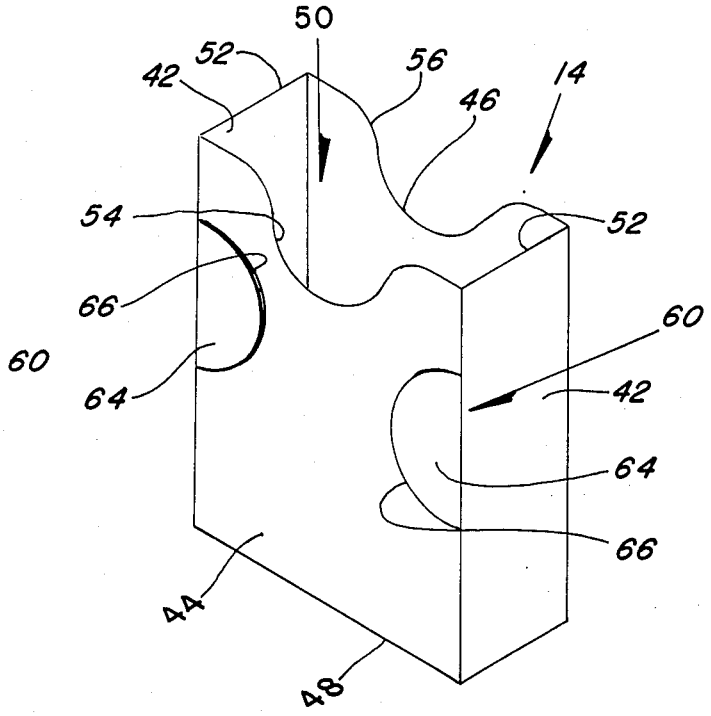
FIG. 3 is a perspective view of the cigarette container box portions of the package with portions broken away to show a component of the stop.
Figure 4:
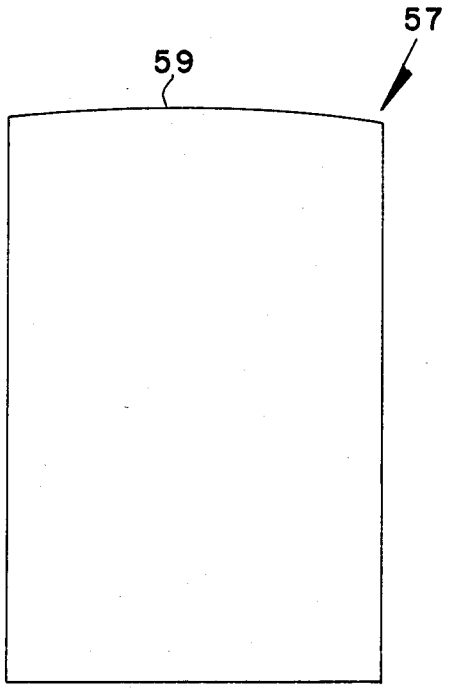
FIG. 4 is a front view of an insert adapted to fit into the container box of FIG. 3.

It has been determined that the rear wall 46 of the container box 14 have a top edge which is convexly arcuate having a radius centered proximate the pivot point of the side box sections and generally of the same curvature as the arc followed by the side box sections 16 and 18 as they move between the open and closed positions about the hinge point provided by the strip of flexible, non-resilient material 40 interconnecting the side box sections 16 and 18 at their floors 26. This arcuate top edge increases the strength of the container box 14 as well as providing a guide for the arcuate movement of the side box sections 16 and 18. As shown in FIG. 3, the top edge 56 of the container box rear wall 46 can be formed in a convex upwardly facing arc (shown in broken lines). However, it is contemplated that this could cause manufacturing complications. Therefore, the top edge 56 of the container box rear wall 46 can be formed straight across the width of the container box 14 (as shown in solid lines in FIG. 3), and an insert panel 57 (see FIG. 4) used to provide the arcuate top edge. With reference to FIG. 4, the insert panel 57 is formed with a convex upwardly facing top edge 59 and is otherwise appropriately sized and configured to be received within the container box 14 in abutting overlaying relationship to the rear wall 46 of the container box 14 with the arcuate top edge 57 of the insert panel 57 projecting above the top edge 56 of the container box rear wall 46. Thus, when inserted in the container box 14, the insert panel 57 appear and function the same as depicted in FIG. 3.

The package 10 is constructed such that there exists a slight frictional force generated between the side box sections 16 and 18 and the article container box 14. This can be accomplished in a number of ways in the package construction. For example, it is contemplated that the width of each of the side box sections 16 and 18 can be sized, relative to the width of the container box 14, to provide slight contact between the front wall 20 of each side box section 16, 18 and front wall 44 of the container box 14, and between the rear wall 22 of each side box section 16, 18 and rear wall 46 of the container box 14. Alternatively, it is also contemplated that the width of each of the side box sections 16 and 18 be larger than the width of the container box 14, and that the side box sections 16 and 18 be positioned somewhat off-center relative to the container box 14 such that the rear wall 22 of each side box section 16, 18 slightly contact the rear wall 46 of the container box 14. The slight functional force generated between the side box sections 16, 18 and the article container box 14 holds in the side box sections 16 and 18 in any position between fully closed and fully open until a manual outside force is applied to either one or both of the side box sections 16 and 18. Thus, either one, or both of the side box sections 16 and 18 can be moved to, for example, a partially open position exposing a portion of the open top 50 of the container box 14, and it will remain in that position until intentionally manually closed or opened to even a greater extent.

With reference to FIG. 2, 3 and 4, the package 10 further includes stop means operatively associated with each of the side box sections 16 and 18 to prevent the side box sections 16 and 18 from moving beyond the fully open position. As shown, the stop means includes mating abutments 60 and 62. An abutment 60 is located at the exterior surface of the front wall 44 of the container box 14 proximate each of the end walls 42 of the container box 14, and an abutment 62 is located the interior surface of the front wall 20 proximate the front edge 32 of each of the side box sections 16 and 18. When a side box section 16 and 18 reaches a fully opened position relative to the container box 14, the abutment 62 of the side box section 16 and 18 contacts the abutment 60 of the container box 14, thus, preventing further movement of the side box section 16 and 18 beyond the fully open position.

Figure 5:
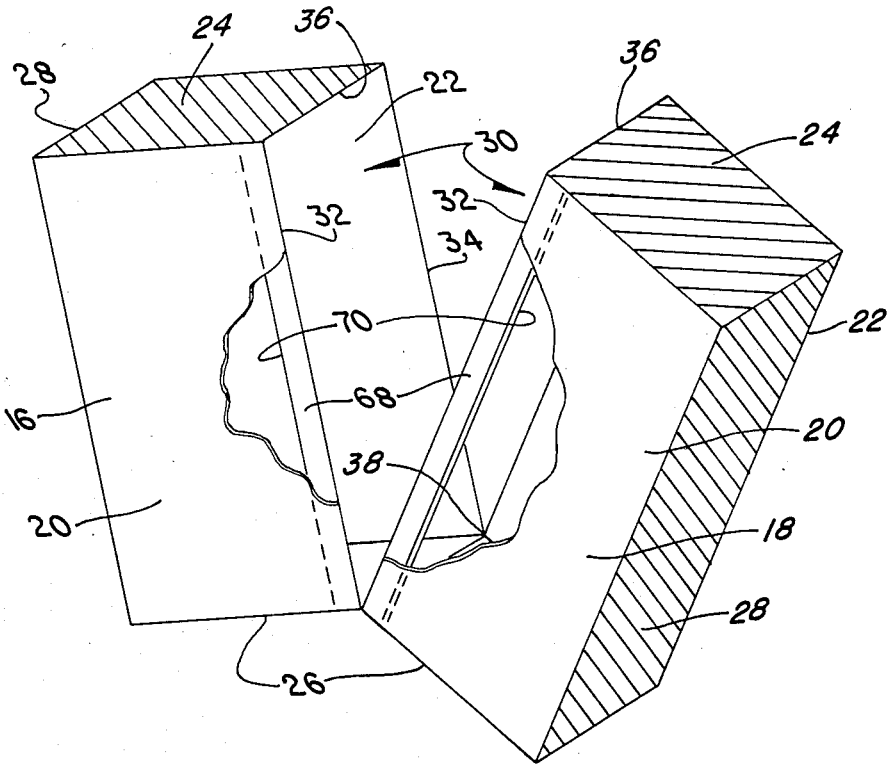
FIG. 5 is a perspective view of a side box section of the package with portions broken away to show details of the component of a stop.

As shown in FIGS. 2, 3 and 5, each abutment 60 of the container box 14 comprises a flange 64 integrally attached to the front wall 44 of the container box 14 near an end wall 42 of the container box 14 and projecting from its point of attachment to the front wall 44 generally outwardly at an angle from the exterior surface of the front wall 44 and extending in a direction generally toward the centerline of the container box 14 providing an abutment edge 66 at its free end portion such that the abutment edges of the flange 64 generally face each other. The abutment flange 64 can be, for example, die cut from the front wall 44 of the container box 14.

Figure 6:
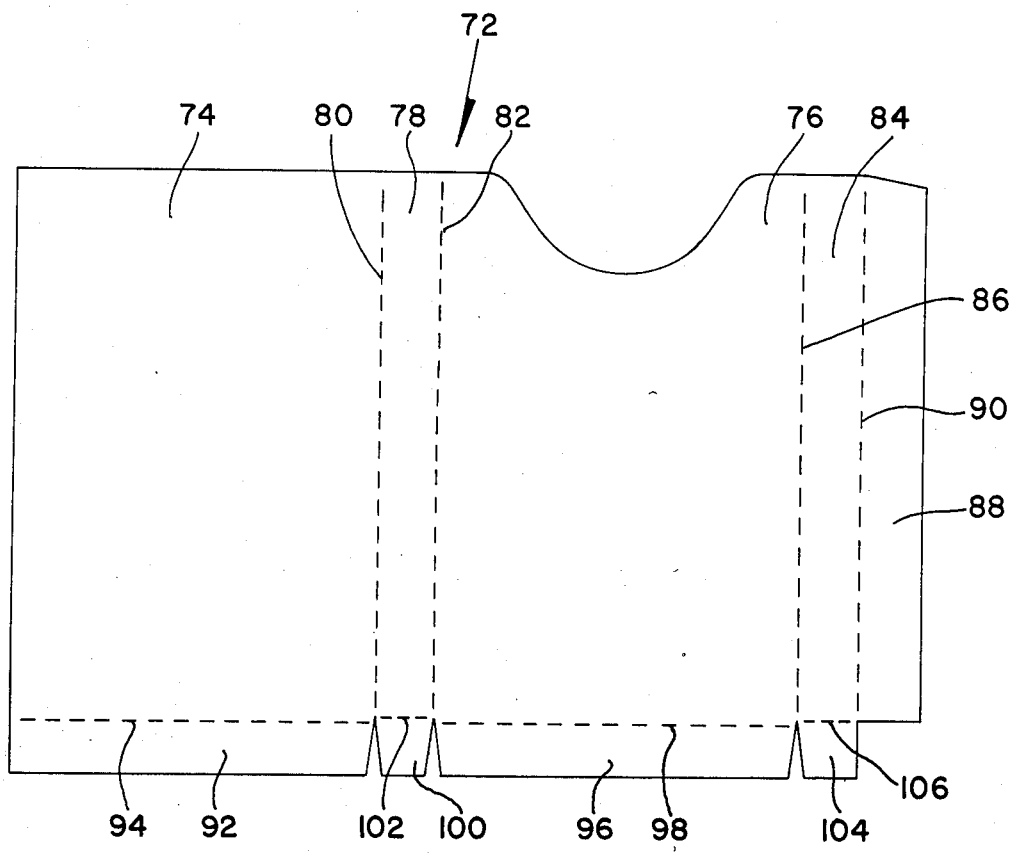
FIG. 6 is a plan view of the blank from which the cigarette container box is fabricated.

As shown in FIGS. 2, 4 and 6, the abutment 62 of each side box section 16 and 18 comprises a flange 68 integrally attached to the front wall 20 near the edge 32 of the front wall 20. The flange 68 overlaps the interior wall surface of the side box section 16, 18 extending from the edge 32 of the front wall 20 in a direction generally toward the end wall 42 of the side box section providing an abutment edge 70 at the end of the flange 68 facing the end wall 42.

With the package 10 assembled with the side box sections 16 and 18 receiving the container box 14, when a side box section 16 and 18 is moved to the fully open position, the abutment edge 70 of the stop flange 68 attached to the side box section will contact the abutment edge 66 of the stop flange 64 attached to the container box 14 preventing further movement of the side box section 16 and 18 beyond the fully open position (See FIG. 2).

Now with reference to FIG. 6, there is shown a blank, generally denoted as the numeral 72, which when assembled forms the container box 14. The container box blank 72 includes various panels and flaps which when folded about appropriate fold lines (shown by broken lines) form the container box 14. As shown, the container box blank 72 includes a rear wall panel 74 and a front wall panel 76 with a first end wall panel 78 located therebetween. The rear wall panel 74 and front wall panel 76 are folded in mutual generally overlaying relationship about fold lines 80 and 82, respectively. The fold lines define the separation between the rear wall panel 74 and first end wall 78, and between the front wall panel 76 and first end wall 78, respectively. A second end wall panel 84 is located at the other side of the front wall panel 76 from the first end wall panel 78. The second end wall panel 84 is folded about fold line 86 to assume a position generally at a right angle to the front wall panel 76. The fold line 86 defines the separation between the second end wall panel 84 and the front wall panel 76. An attachment flange 88 is located at the other side of the second end wall 84 from the front wall panel 76. The attachment flange 88 is folded about fold line 90 to assume a position generally at a right angle to the second end wall panel 84 to overlay the interior wall surface of the rear wall panel 74. The fold line 86 defines the separation between the attachment flange 88 and second end wall panel 84. It should be noted that the fold lines 80, 82, 86, and 90 are all parallel to each other. The attachment flange 88 can be secured to the interior surface of the rear wall panel 74 by an adhesive. A first floor panel 92 is formed at the bottom end of the rear wall panel 74 and is folded about fold line 94 to a position generally at a right angle to the rear wall panel 74. The fold line 94 defines the separation between the first floor panel 92 and the rear wall panel 74. Similarly, a second floor panel 96 is formed at the bottom end of the front wall panel 76 and is folded about fold line 98 to a position generally at a right angle to the front wall panel 76. The fold line 98 defines the separation between the second floor panel 96 and front wall panel 76. It should be noted that the fold lines 94 and 98 are in substantial alignment with each other. A first attachment tab 100 is located at the bottom end of the first end wall panel 78 and is folded about fold line 102 to a position generally at a right angle to the first end wall panel 78. The fold line 102 defines the separation between the first end wall panel 78 and the first attachment tab 100. The first attachment tab 100 is located between the first floor panel 92 and second floor panel 96, and is separated from these floor panels by V-shaped notches. A second attachment tab 104 is located at the bottom end of the second end wall panel 84 and is folded about fold line 106 to a position generally at a right angle to the second end wall panel 84. The fold line 106 defines the separation between the second end wall panel 84 and the second attachment tab 104. The second attachment tab 104 is separated from the second floor panel 96 by a V-shaped notch. It should be noticed that the fold lines 102 and 104 are in substantial alignment with each other, and that they are located in parallel relationship to the fold lines 94 and 98 but spaced above the fold lines 94 and 98 by a distance about equal to the thickness of the blank 72. In the assembly of the container box 14 from the blank 10, the first and second attachment tabs 100 and 104 are folded about the fold lines 102 and 106, respectively, before the first and second floor panels 92 and 96 are folded about the fold lines 94 and 98, respectively, so that the attachment tabs 100 and 104 will be located inside the contain box 14 overlaying the floor panels. As mentioned above, the two abutment stop flanges 64 are cut or punched out of the front wall panel 76 such that they remain integrally attached to the front wall panel 76 near the fold lines 82 and 86.

Figure 7:
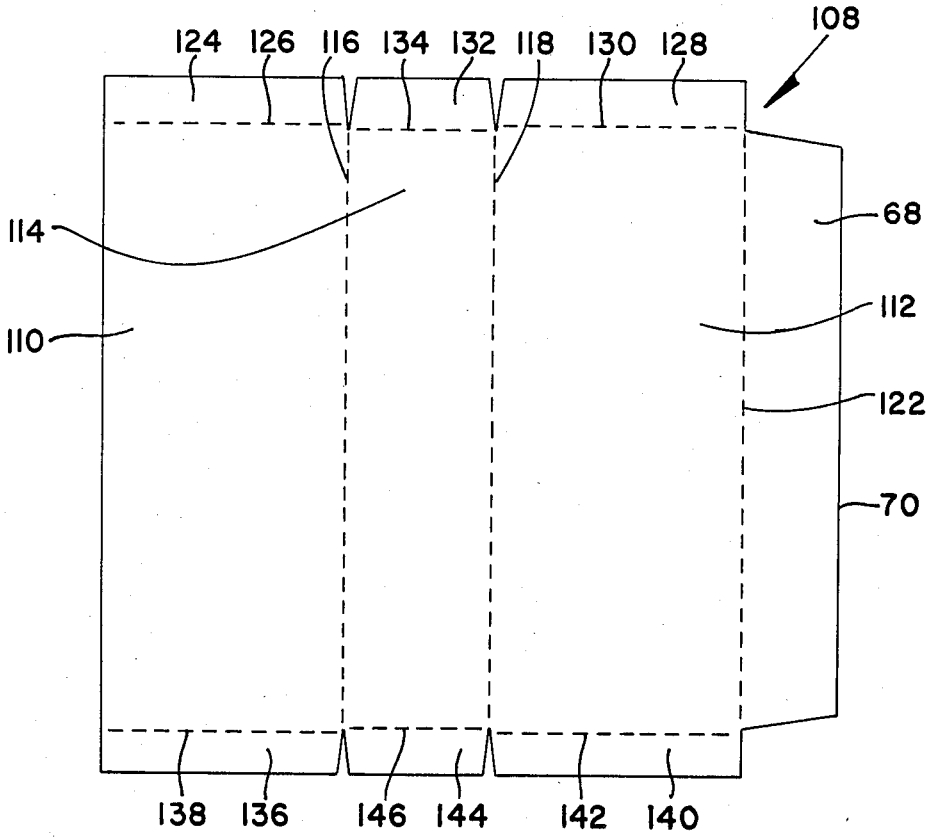
FIG. 7 is a plan view of the blank from which the side box section is fabricated.

Now with reference to FIG. 7, there is shown a blank, generally denoted as the numeral 108, which when assembled forms a side box sections 16,18. The side box section blank 108 includes various panels and flaps which when folded about appropriate fold lines (shown in broken lines) form a side box section 16,18. As shown, the side box blank 108 includes a rear wall panel 110 and front wall panel 112 with a side wall panel 114 located therebetween. The rear wall panel 110 and front wall panel 112 are folded in mutual generally overlaying relationship about fold lines 116 and 118, respectively, such that the side wall panel 114 is perpendicular to the rear wall panel 110 and front wall panel 112. The fold lines defines the separation between the rear wall panel 110 and side wall panel 114, and between front wall panel 112 and rear wall 110, respectively. The stop abutment flange 68 is located at the other side of the front wall panel 112 from the side wall panel 114. The stop abutment flange 68 is folded about fold line 122 through an angle of 180 degrees to a position overlaying the interior surface of the front wall panel 112. The fold line 122, therefore, defines the edge 32 of the front wall 20 of the container box 14, 16, and the free edge of the abutment flange 68 constitutes the abutment edge 70 of the abutment flange 68. The abutment flange 68 can be adhesively attached to the front wall panel 112. It should be noted that the fold lines 116, 118 and 122 are mutually parallel. A first top wall panel 124 is formed at the top end of the rear wall panel 110 and is folded about fold line 126 to a position generally at a right angle to the rear wall panel 110. The fold line 126 defines the separation between the first top wall panel 124 and the rear wall panel 110. Similarly, a second top wall panel 128 is formed at the top end of the front wall panel 112 and is folded about fold line 130 to a position generally at a right angle to the front wall panel 112. The fold line 130 defines the separation between the second top wall panel 128 and the front wall panel 112. It should be noted that the fold lines 126 and 130 are in substantial alignment with each other. A top attachment tab 132 is located at the top of the side wall panel 114 and is folded about fold line 134 to a position generally at a right angle to the side wall panel 114. The fold line 134 defines the separation between the side wall panel 114 and the top attachment tab 132. The attachment tab 132 is thus located between the first top wall panel 124 and record top wall panel 128, and is separated from these top wall panels by V-shaped notches. It should be noticed that the fold line 134 is parallel to the fold lines 126 and 130 but off-set therefrom by a distance corresponding to the thickness of the side box blank 108. A first floor panel 136 is formed at the bottom end of the rear wall panel 110 and is folded about fold line 138 to a position generally at a right angle to the rear wall panel 110. The fold line 138 defines the separation between the first floor panel 136 and the rear wall panel 110. Similarly, a second floor panel 140 is formed at the bottom end of the front wall panel 112 and is folded about fold line 142 to a position generally at a right angle to the front wall panel 112. The fold line 142 defines the separation between the second floor panel 140 and the front wall panel 112. It should be noted that the fold lines 138 and 142 are in substantial alignment with each other. A floor attachment tab 144 is located at the bottom end of the side wall panel 114 and is folded about fold line 146 to a position generally at a right angle to the side wall panel 114. The fold line 146 defines the separation between the side wall panel and the floor attachment tab 144. The floor attachment tab 144 is thus located between the first floor panel 136 and second floor panel 140, and is separated from these floor panels by V-shaped notches. It should be noticed that the fold line 146 is parallel to the fold lines 138 and 142 but is off-set therefrom by a distance corresponding to the thickness of the side box blank 108. In the assembly of the side box section 16, 18, from the blank 108, the top attachment tab 132 is folded about the fold line 134 before the first and second top wall panels 124 and 128 are folded about fold lines 126 and 130, respectively, so that the attachment tab 132 will be located inside the side box section. Likewise, the floor attachment tab 144 is folded about the fold line 146 before the first and second floor panels 136 and 140 are folded about fold lines 138 and 142, respectively, so that the attachment tab 144 will be located inside the side box section.

The foregoing detailed description is given primarily for clearness of understanding and no unnecessary limitations are to be understood therefrom for modifications will become obvious to one skilled in the art upon reading this disclosure and may be made without departing from the spirit of the invention or scope of the claims.

What is claimed is:

1. A package for articles such as cigarettes comprising:

an article container box having two spaced apart, parallel end walls, a front wall, a rear wall spaced apart from and parallel to the front wall, a floor, and an open top defined by the top edges of the end walls, front wall and rear wall;

a first side box having a front wall, a rear wall spaced apart from and parallel to the front wall, a top wall, a floor, a side wall and an open side opposite the side wall defined by the side edges of the front wall, rear wall, top wall and floor;

a second side box having a front wall, a rear wall spaced apart from and parallel to the front wall, a top wall, a floor, a side wall and an open side opposite the side wall defined by the side edges of the front wall, rear wall, top wall and floor;

the container box being symmetrically received within the first and second side boxes with one container box end wall being received through the open side of the first side box and the other container end wall being received through the open side of the second side box;

a strip of flexible, nonresilient material fastened to the floor of each of the side boxes functioning as a hinge about which the side boxes can be freely pivoted selectively either simultaneously or individually in an arcuate path between a closed position cooperating to completely enclose the container box whereat the first and second side boxes are located in side-by-side disposition with the open sides in registered facing relationship with the side edges of the front wall, rear wall, top wall and floor of the first box in aligned abutment with the side edges of the front wall, rear wall, top wall and floor of the second side box, respectively, and the side box top walls symmetrically cooperate to cover the open top of the container box, and an open position whereat the open sides of the first and second side boxes are spaced apart from each other, and the top walls of the first and second side boxes are spaced apart from each other to uncover at least a portion of the open top of the container box;

the container box and side boxes being positioned relative to each other such that either the rear wall of the container box is in constant contact with the rear walls of the side boxes, or the front wall of the container box is in constant contact with the front walls of the side boxes, or both, such as to create a friction force sufficient to hold the side boxes on any position between full open and closed absent the application of a manual force to the side boxes sufficient to overcome the frictional forces;

first stop means associated with the container box and with the first side box to prevent movement of the first side box beyond the full open position; and, second stop means associated with the container box and with the second side box to prevent movement of the second side box beyond the full open position.

2. The package of claim 1, wherein the first and second side boxes are fabricated of a resilient deformable material providing for the selected deformations of the front and rear walls of one or the other of the side boxes toward and into contact with the front and rear walls of the container box, respectively, under the influence of a manual force of sufficient magnitude applied to the exterior surfaces of the front and rear walls of the one side box to create a frictional force between the one side box and container box great enough to prevent movement of the one side box between the open and closed position while the other one of the side boxes is moved between the open and closed positions.

3. The package of claim 1, wherein:

(a) the first stop means comprises:

an abutment edge projecting from one or the other of the front and rear walls of the container box; and, an abutment edge projecting from one or the other of the front and rear walls of the first side box;

the abutment edge on the container box and the abutment edge on the first side box contact each other only when the first side box is in the full open position; and, (b) the second stop means comprises:

an abutment edge projecting from one or the other of the front and rear walls of the container box; and, an abutment edge projecting from one or the other of the front and rear walls of the second side box;

the abutment edge on the container box and the abutment edge on the second side box contact each other only when the second box is in the full open position.

4. The package of claim 3, wherein:

(a) the abutment edge on the container box adapted to contact the abutment edge on the first side box is defined by a flange cut out of the wall of the container box; and, (b) the abutment edge on the container box adapted to contact the abutment edge on the second side box is defined by a flange cut out of the wall of the container box.

5. The package of claim 4, wherein:

(a) the abutment flange of the container box adapted to contact the abutment edge on the first side box is integrally attached to the wall of the container box from which it is cut, and projects from its point of attachment generally outwardly therefrom terminating in the abutment edge; and, (b) the abutment flange of the container box adapted to contact the abutment edge on the second side box is integrally attached to the wall of the container box from which it is cut, and projects from its point of attachment generally outwardly therefrom terminating in the abutment edge.

6. The package of claim 5, wherein the abutment flanges of the container box project from their respective points of attachment to the container box generally toward each other such that the abutment edges thereof generally face each other.

7. The package of claim 6, wherein:

the abutment edge of the first stop means projecting from a wall of the first side box comprises an abutment flange located next to the side edge of the front or rear wall of the first side box spaced inwardly of the open side of the first side box, the abutment edge defined by the abutment flange facing away from the open side of the first side box and being adapted to move into abutment with abutment edge of one of the abutment flanges of the container box only when the first side box is at its full open position relative to the container box; and, the abutment edge of the second stop means projecting from a wall of the second side box comprises an abutment flange located next to the side edge of the front or rear wall of the second side box spaced inwardly of the open side of the second side box, the abutment edge defined by the abutment edge defined by the abutment flange facing away from the open side of the second side box and being adapted to move into abutment with the other one of the abutment flanges of the container box only when the second side box is at its fully open position relative to the container box.

8. The package of claim 1, wherein the top edge of the rear wall of the container box is convexly arcuate curvature generally the same as the arc followed by the side boxes as they move between the opened and closed positions.

9. The package of claim 8, wherein the center of the radius of the arcuate top edge of the container box rear wall is substantially coincidental with the pivot about which the first and second side box move between the open and closed positions.

10. The package of claim 1, further comprising: an insert panel sized and configured to be received within the container box in abutting overlaying relationship to the rear wall of the container box, the insert panel having an convexly arcuate top edge projecting above the top edge of the container box rear wall, the insert panel arcuate top edge having a curvature generally the same as the arc followed by the side boxes as they move between the opened and closed positions.

11. The package of claim 10, wherein the center of radius of the arcuate top edge of the insert panel when inserted in the container box is substantially coincidental with the pivot about which the first and second side boxes move between the open and closed positions.

* * * * *